US010426684B2

(12) United States Patent
Dubois et al.

(10) Patent No.: US 10,426,684 B2
(45) Date of Patent: Oct. 1, 2019

(54) PERSON SUPPORT APPARATUSES INCLUDING PERSON REPOSITIONING ASSEMBLIES

(71) Applicant: Allen Medical Systems, Inc., Batesville, IN (US)

(72) Inventors: Christopher Bennett Dubois, Marlborough, MA (US); Joshua C. Hight, Somerville, MA (US); Ben Hertz, Acton, MA (US); Jeffrey C. Marrion, Acton, MA (US); Jason Stanley Bernotsky, Acton, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 436 days.

(21) Appl. No.: 15/176,824

(22) Filed: Jun. 8, 2016

(65) Prior Publication Data

US 2016/0361218 A1 Dec. 15, 2016

Related U.S. Application Data

(60) Provisional application No. 62/174,102, filed on Jun. 11, 2015.

(51) Int. Cl.

| | |
|---|---|
| ***A61G 13/08*** | (2006.01) |
| ***A61G 13/12*** | (2006.01) |
| ***A61G 13/04*** | (2006.01) |
| ***A61G 13/00*** | (2006.01) |

(52) U.S. Cl.

CPC ..... *A61G 13/08* (2013.01); *A61G 13/0054* (2016.11); *A61G 13/04* (2013.01); *A61G 13/122* (2013.01); *A61G 13/121* (2013.01); *A61G 13/1245* (2013.01)

(58) Field of Classification Search

CPC ..... A61G 13/08
USPC ..... 5/607, 609, 613
See application file for complete search history.

(56) References Cited

U.S. PATENT DOCUMENTS

| | | | | |
|---|---|---|---|---|
| 1,740,906 | A * | 12/1929 | Rothauszky ..... | A47C 20/041 5/608 |
| 2,188,592 | A | 1/1940 | Hosken et al. | |
| 3,226,734 | A | 1/1966 | Coventon | |
| 3,302,218 | A | 2/1967 | Stryker | |
| 3,827,089 | A | 8/1974 | Grow | |

(Continued)

FOREIGN PATENT DOCUMENTS

| | | |
|---|---|---|
| DE | 1162508 B | 2/1964 |
| DE | 3438956 A1 | 5/1985 |

(Continued)

*Primary Examiner* — Fredrick C Conley
(74) *Attorney, Agent, or Firm* — Dinsmore & Shohl LLP

(57) ABSTRACT

A person support apparatus includes a base frame, a primary support frame supported on the base frame, where the primary support frame extends in a longitudinal direction, a support deck coupled to the primary support frame, the support deck including an upper segment positioned at a head end of the person support apparatus, a leg segment positioned at a foot end of the person support apparatus, and a torso segment positioned between the upper segment and the leg segment in the longitudinal direction, where at least one of the upper segment, the torso segment, and the leg segment rotates with respect to the primary support frame about an axis that extends in the longitudinal direction.

16 Claims, 7 Drawing Sheets

(56) References Cited

U.S. PATENT DOCUMENTS

| | | | | |
|---|---|---|---|---|
| 3,832,742 | A | 9/1974 | Stryker | |
| 3,859,982 | A | 1/1975 | Dove | |
| 4,225,988 | A * | 10/1980 | Cary | A61G 7/015 5/607 |
| 4,244,358 | A | 1/1981 | Pyers | |
| 4,356,577 | A | 11/1982 | Taylor et al. | |
| 4,603,452 | A * | 8/1986 | Paciorek | E05D 7/10 16/262 |
| 4,856,128 | A | 8/1989 | Alsip et al. | |
| 4,924,537 | A | 5/1990 | Alsip et al. | |
| 4,937,901 | A | 7/1990 | Brennan | |
| 4,939,801 | A | 7/1990 | Schaal et al. | |
| 4,944,054 | A | 7/1990 | Bossert | |
| 5,020,170 | A | 6/1991 | Ruf | |
| 5,088,706 | A | 2/1992 | Jackson | |
| 5,152,024 | A | 10/1992 | Chrones | |
| 5,210,887 | A | 5/1993 | Kershaw | |
| 5,274,862 | A | 1/1994 | Palmer et al. | |
| 5,524,304 | A | 6/1996 | Shutes | |
| 5,640,729 | A * | 6/1997 | Marino | A61G 7/001 5/607 |
| 6,049,923 | A | 4/2000 | Ochiai | |
| 6,076,525 | A | 6/2000 | Hoffman | |
| 6,094,760 | A | 8/2000 | Nonaka et al. | |
| 6,108,838 | A | 8/2000 | Connolly et al. | |
| 6,112,349 | A | 9/2000 | Connolly | |
| 6,230,342 | B1 | 5/2001 | Haugs | |
| 6,260,220 | B1 | 7/2001 | Lamb et al. | |
| 6,282,736 | B1 | 9/2001 | Hand et al. | |
| 6,385,801 | B1 | 5/2002 | Watanabe et al. | |
| 6,496,991 | B1 | 12/2002 | Votel | |
| 6,499,160 | B2 | 12/2002 | Hand et al. | |
| 6,615,430 | B2 | 9/2003 | Heimbrock | |
| 6,701,553 | B1 | 3/2004 | Hand et al. | |
| 6,721,976 | B2 | 4/2004 | Schwaegerle | |
| 6,857,144 | B1 | 2/2005 | Huang | |
| 6,874,181 | B1 | 4/2005 | Vijayendran | |
| 6,986,179 | B2 | 1/2006 | Varadharajulu et al. | |
| 7,137,160 | B2 | 11/2006 | Hand et al. | |
| 7,152,261 | B2 | 12/2006 | Jackson | |
| 7,197,778 | B2 | 4/2007 | Sharps | |
| 7,234,180 | B2 | 6/2007 | Horton et al. | |
| 7,290,302 | B2 | 11/2007 | Sharps | |
| 7,343,635 | B2 | 3/2008 | Jackson | |
| 7,496,980 | B2 | 3/2009 | Sharps | |
| 7,565,708 | B2 | 7/2009 | Jackson | |
| 7,600,281 | B2 | 10/2009 | Skripps | |
| 7,653,953 | B2 | 2/2010 | Lopez-Sansalvador et al. | |
| 7,739,762 | B2 | 6/2010 | Lamb et al. | |
| 8,042,208 | B2 | 10/2011 | Gilbert et al. | |
| 8,056,163 | B2 | 11/2011 | Lemire et al. | |
| 8,060,960 | B2 | 11/2011 | Jackson | |
| 8,234,730 | B2 | 8/2012 | Skripps | |
| 8,286,283 | B2 | 10/2012 | Copeland et al. | |
| 8,381,331 | B2 | 2/2013 | Sharps et al. | |
| 8,397,323 | B2 | 3/2013 | Skripps et al. | |
| 8,584,281 | B2 | 11/2013 | Diel et al. | |
| 8,635,725 | B2 | 1/2014 | Tannoury et al. | |
| 8,677,529 | B2 | 3/2014 | Jackson | |
| 8,707,476 | B2 | 4/2014 | Sharps | |
| 8,707,484 | B2 | 4/2014 | Jackson et al. | |
| 8,719,979 | B2 | 5/2014 | Jackson | |
| 8,782,832 | B2 | 7/2014 | Blyakher et al. | |
| 8,826,474 | B2 | 9/2014 | Jackson | |
| 8,826,475 | B2 | 9/2014 | Jackson | |
| 8,839,471 | B2 | 9/2014 | Jackson | |
| 8,844,077 | B2 | 9/2014 | Jackson et al. | |
| 8,856,986 | B2 | 10/2014 | Jackson | |
| D720,076 | S | 12/2014 | Sharps et al. | |
| 8,938,826 | B2 | 1/2015 | Jackson | |
| 8,978,180 | B2 | 3/2015 | Jackson | |
| 2008/0000028 | A1 | 1/2008 | Lemire et al. | |
| 2009/0126116 | A1 | 5/2009 | Lamb et al. | |
| 2009/0205139 | A1 | 8/2009 | Van Deursen et al. | |
| 2009/0282614 | A1 | 11/2009 | Jackson | |
| 2010/0192300 | A1 | 8/2010 | Tannoury et al. | |
| 2011/0107516 | A1 | 5/2011 | Jackson et al. | |
| 2012/0198625 | A1 | 8/2012 | Jackson | |
| 2013/0111666 | A1 | 5/2013 | Jackson | |
| 2013/0205500 | A1 | 8/2013 | Jackson | |
| 2013/0219623 | A1 | 8/2013 | Jackson | |
| 2013/0254995 | A1 | 10/2013 | Jackson | |
| 2013/0254996 | A1 | 10/2013 | Jackson | |
| 2013/0254997 | A1 | 10/2013 | Jackson | |
| 2013/0312181 | A1 | 11/2013 | Jackson et al. | |
| 2013/0312187 | A1 | 11/2013 | Jackson | |
| 2013/0312188 | A1 | 11/2013 | Jackson | |
| 2013/0326813 | A1 | 12/2013 | Jackson | |
| 2014/0007349 | A1 | 1/2014 | Jackson | |
| 2014/0020181 | A1 | 1/2014 | Jackson | |
| 2014/0033436 | A1 | 2/2014 | Jackson | |
| 2014/0068861 | A1 | 3/2014 | Jackson et al. | |
| 2014/0082842 | A1 | 3/2014 | Jackson | |
| 2014/0109316 | A1 | 4/2014 | Jackson et al. | |
| 2014/0173826 | A1 | 6/2014 | Jackson | |
| 2014/0196212 | A1 | 7/2014 | Jackson | |
| 2014/0201913 | A1 | 7/2014 | Jackson | |
| 2014/0201914 | A1 | 7/2014 | Jackson | |
| 2014/0208512 | A1 | 7/2014 | Jackson | |
| 2014/0317847 | A1 | 10/2014 | Jackson | |
| 2015/0059094 | A1 | 3/2015 | Jackson | |
| 2015/0150743 | A1 | 6/2015 | Jackson | |

FOREIGN PATENT DOCUMENTS

| | | | |
|---|---|---|---|
| DE | 4039907 | A1 | 7/1991 |
| DE | 4429062 | A1 | 2/1996 |
| DE | 19723927 | A1 | 12/1998 |
| DE | 10158470 | A1 | 6/2003 |
| DE | 202008001952 | U1 | 6/2008 |
| EP | 1210049 | A1 | 6/2002 |
| EP | 1159947 | B1 | 9/2006 |
| WO | 8500967 | A1 | 3/1985 |
| WO | 03096958 | A1 | 11/2003 |
| WO | 2004026212 | A1 | 4/2004 |

* cited by examiner

PERSON SUPPORT APPARATUSES INCLUDING PERSON REPOSITIONING ASSEMBLIES

CROSS REFERENCE TO RELATED APPLICATIONS

This application claims the benefit of priority under 35 U.S.C. § 119 to U.S. Provisional Application Ser. No. 62/174,102, filed Jun. 11, 2015, and entitled "Person Support Apparatuses Including Person Repositioning Assemblies" the entire disclosure of which is incorporated by reference.

BACKGROUND

Field

The present specification generally relates to person support apparatuses and, more specifically, to person support apparatuses including person repositioning assembly.

Technical Background

In some surgical procedures, such as a spinal procedure, it may be necessary to reposition a patient between various positions. For example, a surgical procedure may require that a patient is initially oriented in a prone position and may subsequently require that the patient be repositioned to lie on his or her side, or vice versa. A common technique in conventional practice is to summon as many colleagues as practical to lift and maneuver the patient between the various positions. This risk of mishandling the patient makes this technique undesirable.

Accordingly, a need exists for alternative person support apparatuses that include person repositioning assemblies.

SUMMARY

In one embodiment, a person support apparatus includes a base frame, a primary support frame supported on the base frame, where the primary support frame extends in a longitudinal direction, a support deck coupled to the primary support frame, the support deck including an upper segment positioned at a head end of the person support apparatus, a leg segment positioned at a foot end of the person support apparatus, and a torso segment positioned between the upper segment and the leg segment in the longitudinal direction, where at least one of the upper segment, the torso segment, and the leg segment rotates with respect to the primary support frame about an axis that extends in the longitudinal direction.

In another embodiment, a person support apparatus includes a base frame, a primary support frame supported on the base frame, the primary support frame including a longitudinal frame that extends in a longitudinal direction and is positioned above the base frame in a vertical direction, a support deck coupled to the longitudinal frame of the primary support frame, and a repositioning assembly coupled to at least a portion of the support deck, the repositioning assembly including at least one rocker member movably coupled to the primary support frame, the at least one rocker member extending in a direction that is transverse to the longitudinal direction, and an actuator coupled to the primary support frame and engaged with the at least one rocker member, where the actuator moves the at least one rocker member with respect to the primary support frame.

In yet another embodiment, a person support apparatus includes a base frame, a primary support frame supported on the base frame, the primary support frame including a longitudinal frame that extends in a longitudinal direction and is positioned above the base frame in a vertical direction, where at least a portion of the longitudinal frame extends in a horizontal plane, a support deck coupled to the longitudinal frame of the primary support frame, the support deck including a torso segment including a first portion and a second portion severally coupled to the first portion, and a repositioning assembly coupled to at least a portion of the support deck and movably coupled to the primary support frame, where the repositioning assembly moves the torso segment between a first position in which the first portion is co-planar with the horizontal plane and a second position in which the second portion is co-planar with the horizontal plane.

Additional features and advantages of the embodiments described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1A:
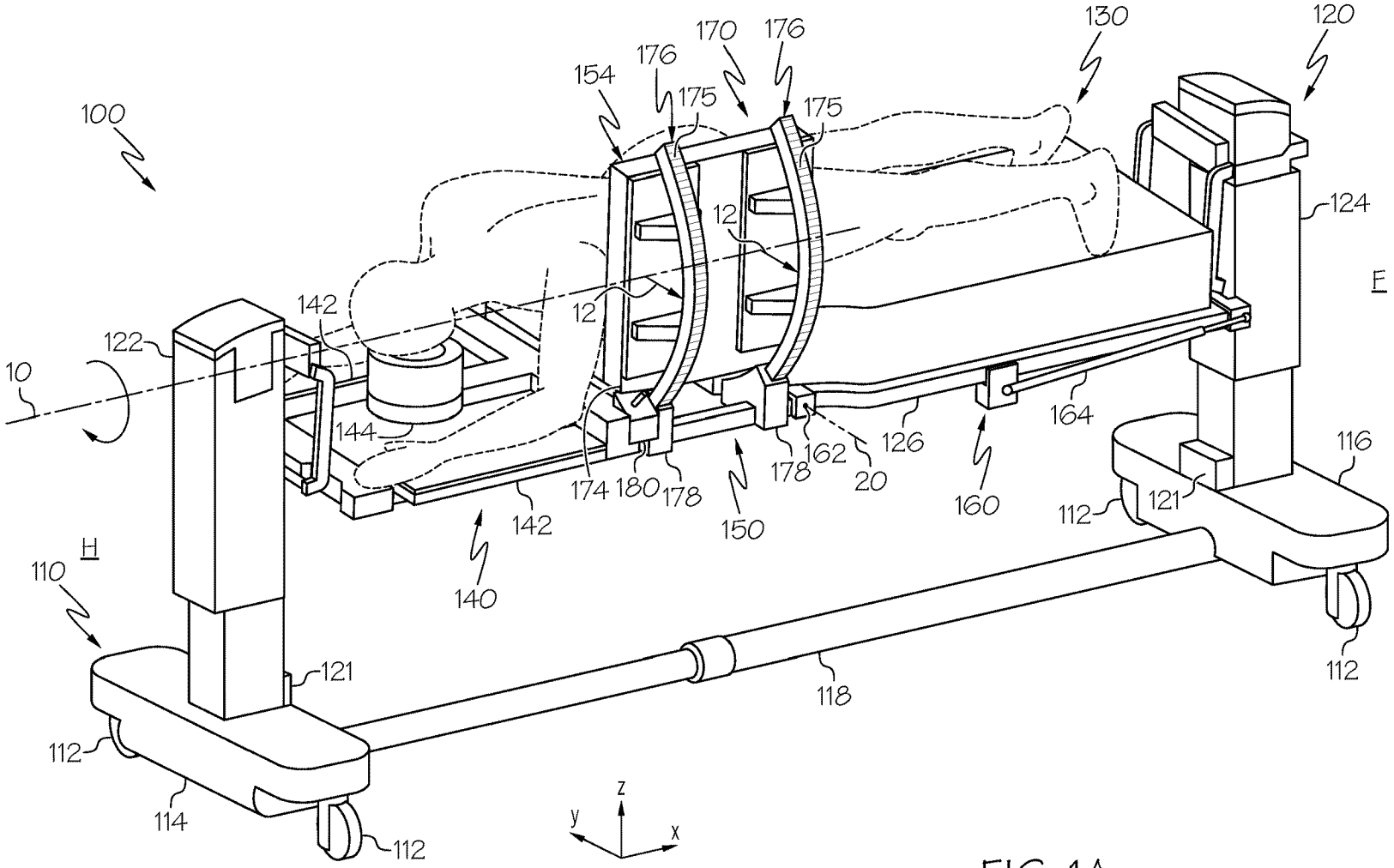
FIG. 1A schematically depicts a perspective view of a person support apparatus including a person repositioning assembly according to one or more embodiments shown or described herein.

Reference will now be made in detail to embodiments of person support apparatuses that include person repositioning assemblies, examples of which are illustrated in the accompanying drawings. Whenever possible, the same reference numerals will be used throughout the drawings to refer to the same or like parts. One embodiment of a person support apparatus is depicted in FIG. 1A, in which the person support apparatus includes a base frame and a primary support frame supported on the base frame, where the primary support frame extends in a longitudinal direction. The person support apparatus further includes a support deck coupled to the primary support frame, the support deck including an upper segment positioned at a head end of the person support apparatus, a leg segment positioned at a foot end of the person support apparatus, and a torso segment positioned between the upper segment and the leg segment in the longitudinal direction. At least one of the upper segment, the torso segment, and the leg segment rotates with respect to the primary support frame about an axis that extends in the longitudinal direction to reposition a patient positioned on the person support apparatus. Person support apparatuses with repositioning assemblies will be described in more detail herein with specific reference to the appended drawings.

As used herein, the term "longitudinal direction" refers to the forward-rearward direction of the person support apparatus (i.e., in the +/−X-direction as depicted). The term "lateral direction" refers to the cross-direction of the person support apparatus (i.e., in the +/−Y-direction as depicted), and is transverse to the longitudinal direction. The term "vertical direction" refers to the upward-downward direction of the person support apparatus (i.e., in the +/−Z-direction as depicted), and is transverse to the lateral and the longitudinal directions. The terms "head end" and "foot end" refer to the relative location of components of the person support apparatus in the longitudinal direction.

The phrase "communicatively coupled" is used herein to describe the interconnectivity of various components of steering system and means that the components are connected either through wires, optical fibers, or wirelessly such that electrical, optical, and/or electromagnetic signals may be exchanged between the components.

Referring to FIG. 1A, a person support apparatus 100 is depicted. The person support apparatus 100 may include, for example, a two-column operating table. The person support apparatus 100 generally includes a base frame 110, a primary support frame 120 that is supported by the base frame 110, and a support deck 130 coupled to the primary support frame 120.

The base frame 110 of the person support apparatus 100 includes a forward portion 114 positioned at a head end of the person support apparatus 100 and a rearward portion 116 positioned at a foot end of the person support apparatus 100. The forward portion 114 and the rearward portion 116 are spaced apart from one another in the longitudinal direction and may be coupled to one another by a central portion 118 that extends between the forward portion 114 and the rearward portion 116 in the longitudinal direction. The central portion 118 may extendable and/or retractable in the longitudinal direction, thereby increasing or decreasing the distance between the forward portion 114 and the rearward portion 116 in the longitudinal direction. In embodiments, the forward portion 114 and the rearward portion 116 are coupled to a plurality of rollers 112, such that the person support apparatus 100 may be moved along a surface, such as a floor.

The primary support frame 120 extends upward from the base frame 110 of the person support apparatus 100. In the embodiment depicted in FIG. 1A, the primary support frame 120 includes a forward column 122 that extends upward from the forward portion 114 of the base frame 110 in the vertical direction. The primary support frame 120 further includes a rearward column 124 that extends upward from the rearward portion 116 of the base frame 110 in the vertical direction. The forward column 122 is positioned at the head end of the person support apparatus 100 and the rearward column 124 is positioned at the foot end of the person support apparatus 100, and the forward column 122 is spaced apart from the rearward column 124 in the longitudinal direction. In embodiments, the forward column 122 and the rearward column 124 are coupled to the forward portion 114 and the rearward portion 116 of the base frame 110, respectively. Alternatively, the forward column 122 and the rearward column 124 may be integral with the forward portion 114 and the rearward portion 116 of the base frame 110, respectively.

The primary support frame 120 includes a longitudinal frame 126 that is positioned above the base frame 110 in the vertical direction and that extends between the forward column 122 and the rearward column 124 in the longitudinal direction. In the embodiment depicted in FIG. 1A, the longitudinal frame 126 generally extends in the horizontal plane (i.e., the X-Y plane as depicted). In other embodiments, the longitudinal frame 126 may be contoured and may include portions that extend out of the horizontal plane. The longitudinal frame 126 supports and may be coupled to the support deck 130, which extends between the forward column 122 and the rearward column 124 in the longitudinal direction.

The forward column 122 and the rearward column 124 may be adjustable in the vertical direction such that the forward column 122 and the rearward column 124 may raise or lower the longitudinal frame 126 with respect to the base frame 110 in the vertical direction. In embodiments, at least one column actuator 121 coupled to the forward column 122 and/or the rearward column 124 and moves the forward column 122 and the rearward column 124 upward and downward in the vertical direction with respect to the base frame 110. The column actuator 121 may be a powered actuator, such as an electric motor or the like, or may be a manually powered, such as by a footpedal, a crank, or the like. The column actuator 121 include a linear actuator, such as a screw, a wheel and axle, a cam, a hydraulic actuator, a pneumatic actuator, a pezioelectric actuator, an electromechanical actuator, or the like.

Figure 4:
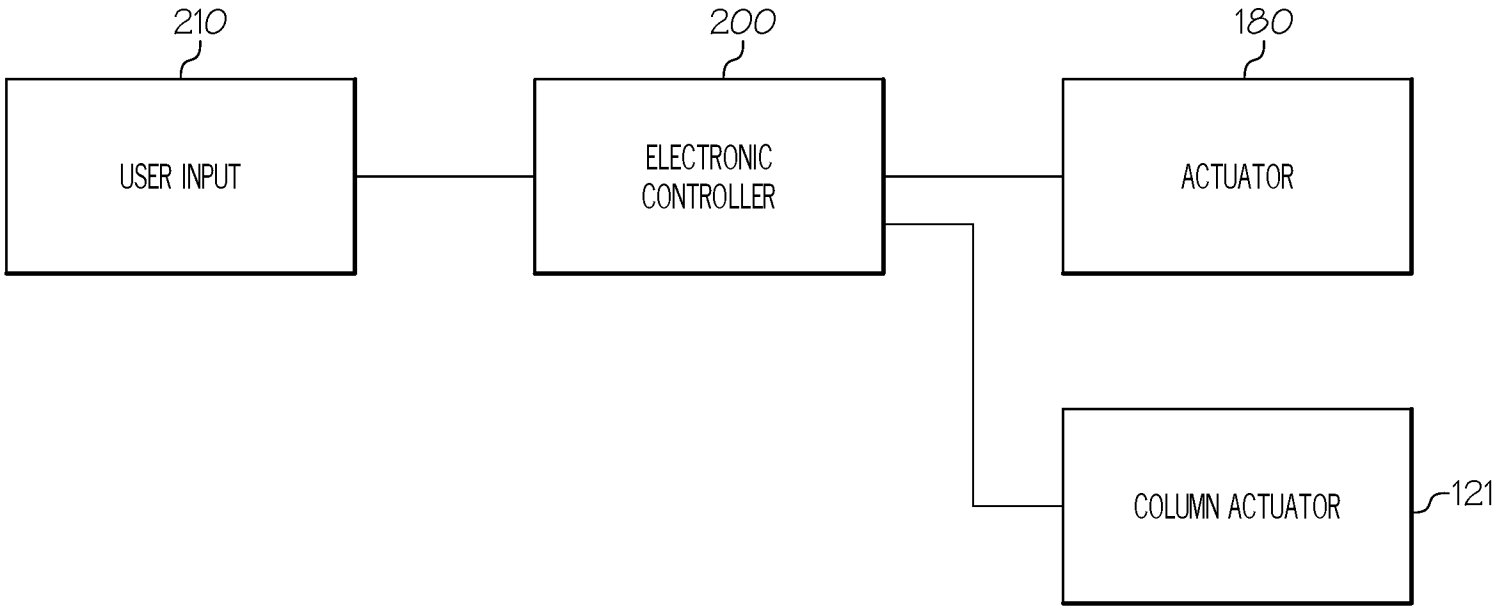
FIG. 4 schematically depicts a block diagram of a control system for the person support apparatus of FIG. 1A.

Referring to FIG. 4, in embodiments where the column actuator 121 includes an electric motor, the column actuator 121 may be communicatively coupled to an electronic controller 200. The electronic controller 200 includes a processor and a memory storing computer readable and executable instructions, which, when executed by the processor, facilitate operation of the column actuator 121. In particular, the electronic controller 200 sends a signal to the at least one column actuator 121 to raise or lower the forward column 122 and/or the rearward column 124 in the vertical direction. A user input 210 is communicatively coupled to the electronic controller 200. The user input 210 includes a device that allows a user to input various parameters into the electronic controller 200 to facilitate operation of the person support apparatus 100. For example, a healthcare professional may utilize the user input 210 to send a signal to the electronic controller 200 to command the at least one actuator 121 to raise or lower the forward column 122 and/or the rearward column 124 in the vertical direction. In embodiments, the user input 210 may include various user input devices, including, but not limited to, graphical user interfaces (GUIs), keyboards, pendants, or the like.

Referring again to FIG. 1A, the forward column 122 and the rearward column 124 may be raised and lowered in the vertical direction independent of one another such that the longitudinal frame 126 may be tilted with respect to the horizontal plane (i.e., the X-Y plane as depicted). For example, the forward column 122 may be raised with respect to the rearward column 124 in the vertical direction such that the head end of the longitudinal frame 126 is positioned higher than the foot end of the longitudinal frame 126 in the vertical direction (i.e., a reverse Trendelenburg position). Conversely, the rearward column 124 may be raised with respect to the forward column 122 in the vertical direction, such that the foot end of the longitudinal frame 126 is positioned higher than the head end of the longitudinal frame 126 in the vertical direction (i.e., a Trendelenburg position). In embodiments, both the forward column 122 and the rearward column 124 of the primary support frame 120 may be raised or lowered in the vertical direction simultaneously, thereby raising both the head end and the foot end of the longitudinal frame 126.

The support deck 130 is coupled to the longitudinal frame 126 and includes one or more segments that are positioned between the forward column 122 and the rearward column 124 in the longitudinal direction to support a patient on the person support apparatus 100. In the embodiment depicted in FIG. 1A, the support deck 130 includes an upper segment 140 positioned at the head end of the person support apparatus 100 which supports the upper body and/or the head and arms of a patient. The support deck 130 further includes a leg segment 160 positioned at the foot end of the person support apparatus 100 which supports the lower body and/or the legs of a patient. The support deck 130 includes a torso segment 150 that is positioned between the upper segment 140 and the leg segment 160 in the longitudinal direction which supports a torso and/or a mid-section of a patient.

Each of the upper segment 140, the torso segment 150, and the leg segment 160 include generally planar surfaces that support a patient on the person support apparatus 100. In some embodiments, the upper segment 140, the torso segment 150, and/or the leg segment 160 may include contoured or shaped surfaces that accommodate a patient. For example, in the embodiment depicted in FIG. 1A, the upper segment 140 includes a pillow portion 144, and arm portions 142 that accommodate a patient's head and arms, respectively. The torso segment 150 and the leg segment 160 may similarly include features and/or contours that accommodate a patient's torso and lower body, respectively.

Figure 3A:
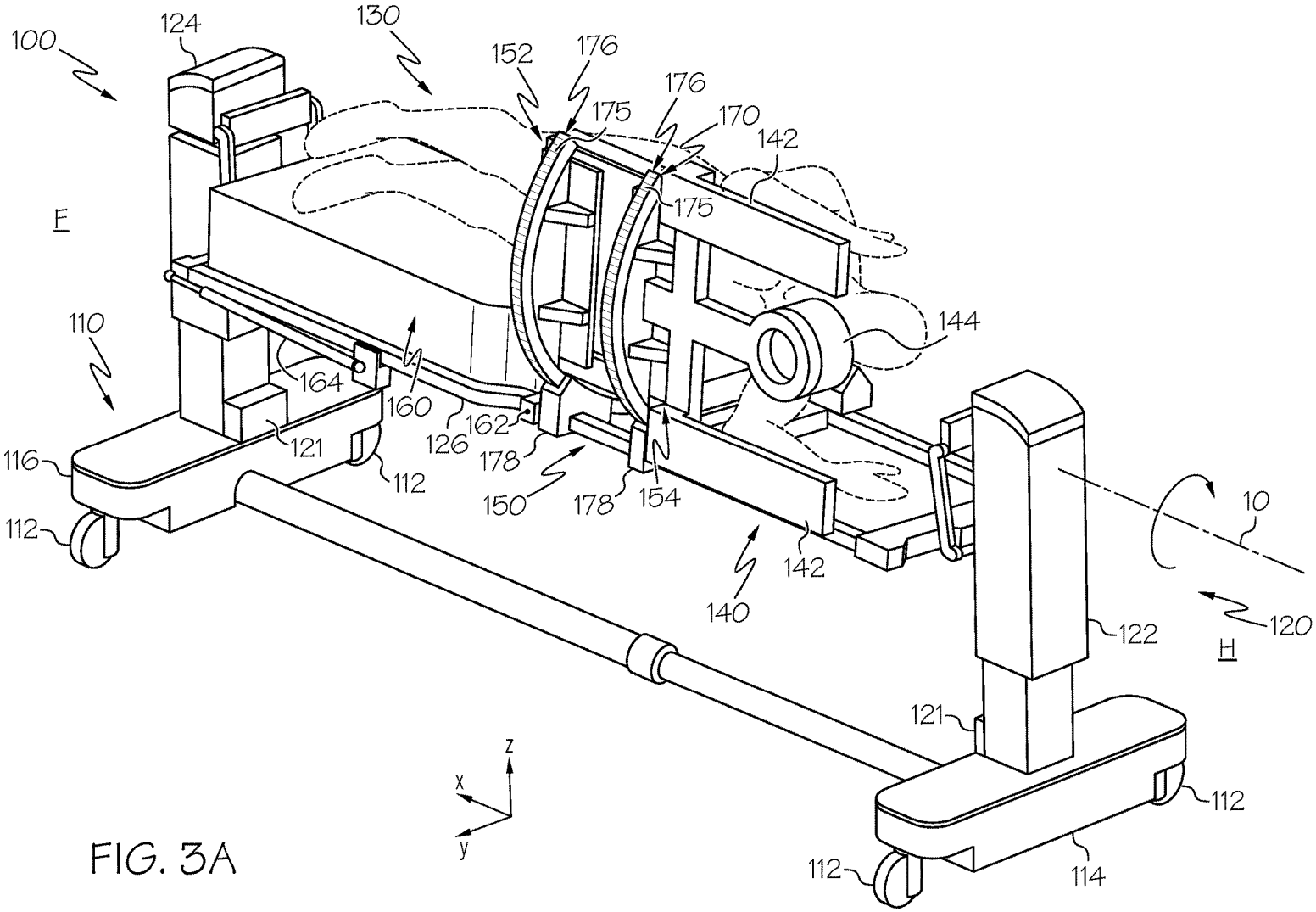
FIG. 3A schematically depicts a perspective view of the person support apparatus of FIG. 1A with a patient in a lateral position according to one or more embodiments shown or described herein.
Figure 3B:
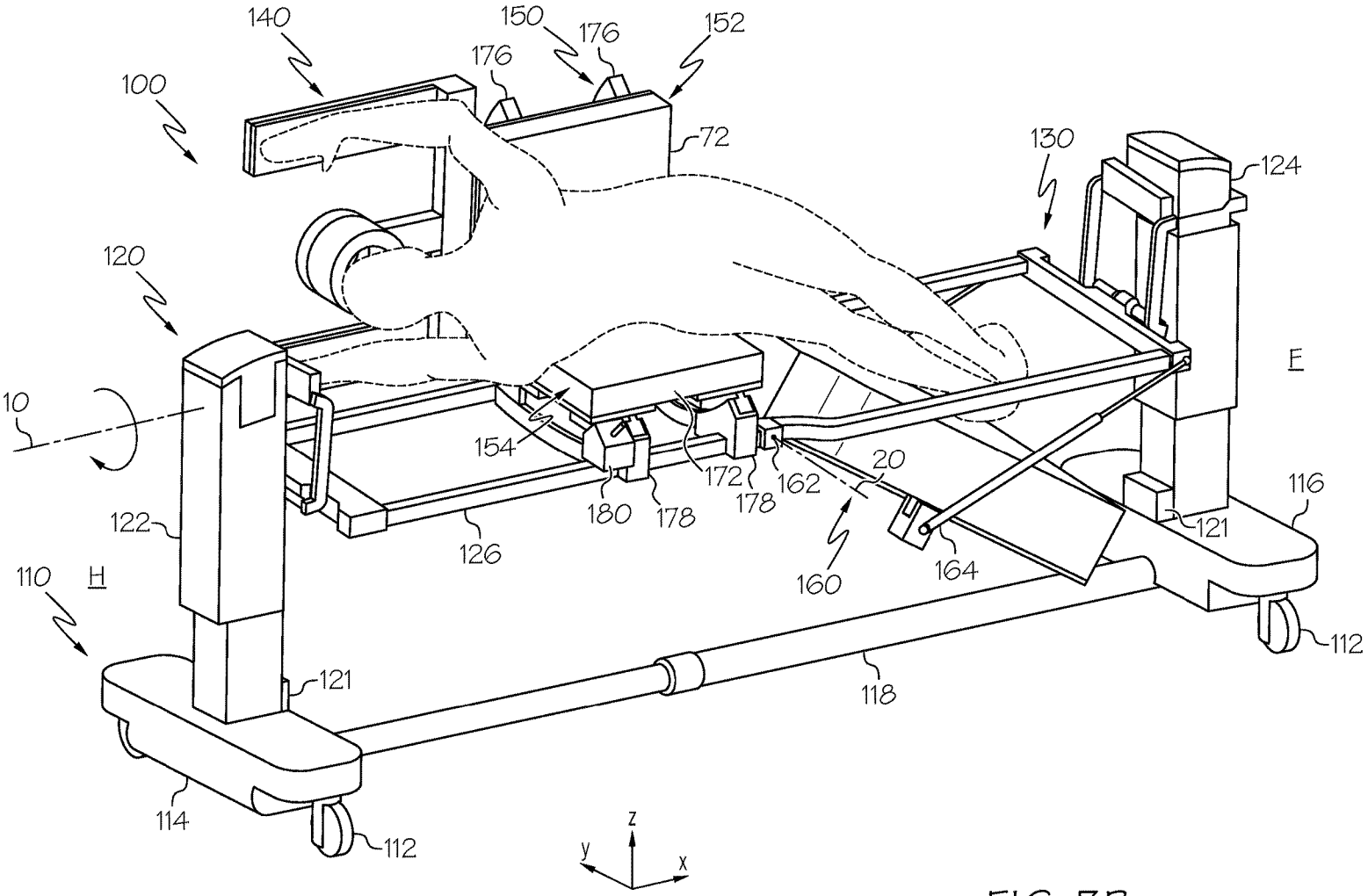
FIG. 3B schematically depicts another perspective view of the person support apparatus of FIG. 1A with a patient in a lateral position according to one or more embodiments shown or described herein.

Referring to FIG. 3B, the leg segment 160 is pivotally coupled to the longitudinal frame 126 at a leg segment pivot 162. The leg segment 160 pivots about an axis 20 at the leg segment pivot 162, where the axis 20 extends in the lateral direction. The leg segment 160 may be coupled to the longitudinal frame 126 by one or more dampers 164 that dampen movement of the leg segment 160 about the leg segment pivot 162. The one or more dampers 164 may include a variety of dampers, including, but not limited to, a linear damper or the like.

By pivoting at the leg segment pivot 162, the leg segment 160 may be lowered in the vertical direction with respect to the torso segment 150 and the upper segment 140. By lowering the leg segment 160 in the vertical direction, a patient's legs and lower body may be positioned lower than the torso of the patient, which may assist with aligning and orienting a patient during surgery. While the leg segment 160 is described and depicted as being pivotally coupled to the longitudinal frame 126, it should be understood that the leg segment 160 may be rigidly coupled to the longitudinal frame 126 and the torso segment 150 and/or the upper segment 140 may be pivotally coupled to the longitudinal frame 126.

Figure 1B:
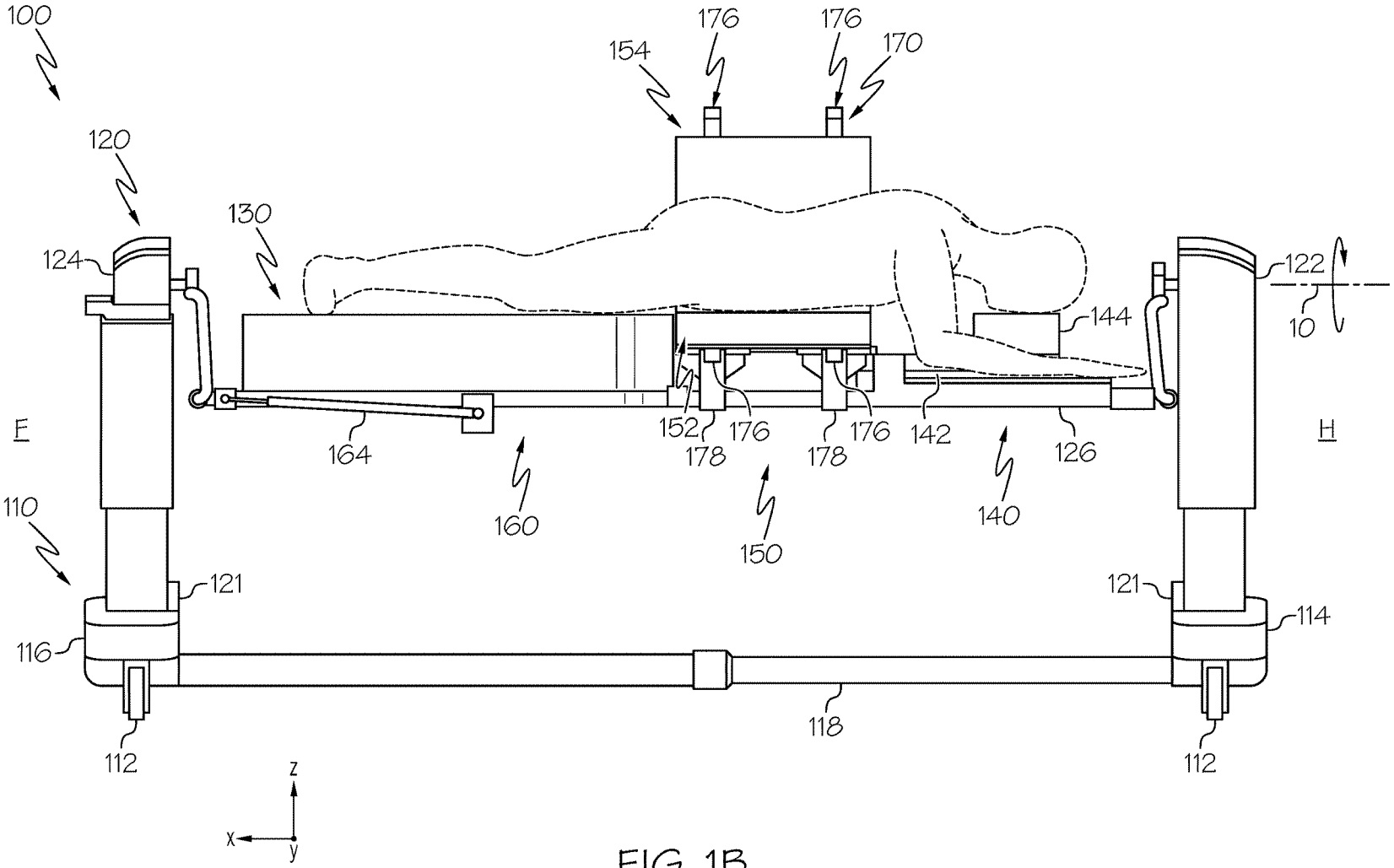
FIG. 1B schematically depicts a side view of the person support apparatus of FIG. 1A according to one or more embodiments shown or described herein.
Figure 1C:
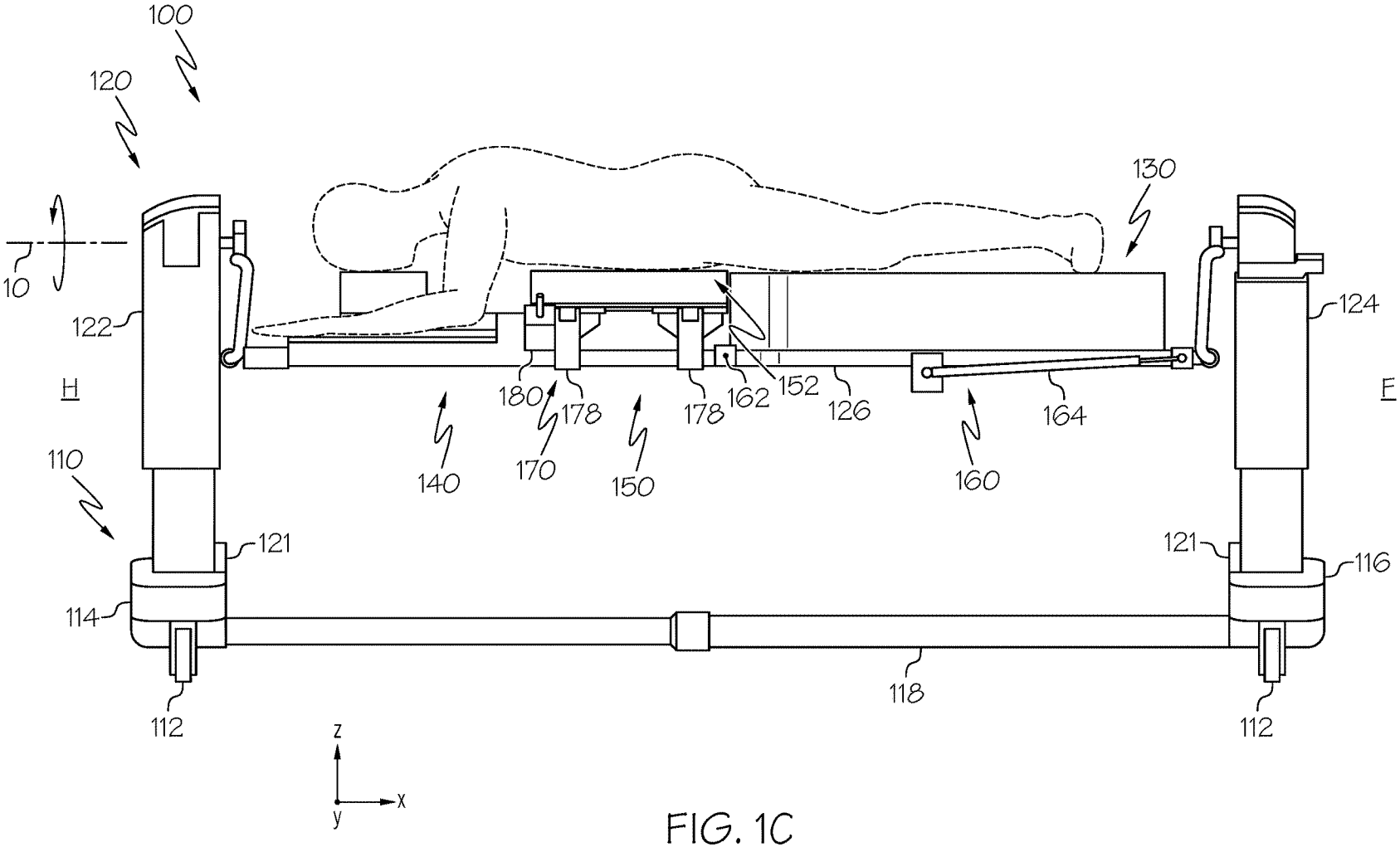
FIG. 1C schematically depicts another side view of the person support apparatus of FIG. 1A according to one or more embodiments shown or described herein.

Referring to FIG. 1B, the torso segment 150 includes one or more portions that may be selectively and severally coupled to one another. In the embodiment depicted in FIG. 1B, the torso segment 150 includes a first portion 152 that is severally coupled to a second portion 154. As shown in FIG. 1C, the second portion 154 (FIG. 1B) is severally coupled to and may be removed from the first portion 152. The first portion 152 and the second portion 154 of the torso segment 150 are oriented transverse to one another. The first portion 152 and the second portion 154 of the torso segment 150 facilitate repositioning of a patient on the person support apparatus 100, as will be described in greater detail herein.

Referring again to FIG. 1A, a repositioning assembly 170 is coupled to the torso segment 150. Additionally or alternatively, the repositioning assembly 170 may be coupled to the upper segment 140. The repositioning assembly 170 facilitates repositioning of a patient on the person support apparatus 100 and includes a pair of rocker members 176 coupled to the second portion 154 of the torso segment 150 and a pair of rocker members 176 coupled to the first portion 152 (FIG. 1B) of the torso segment 150. While the embodiment shown in FIGS. 1A and 1B depicts a pair of rocker members 176 coupled to each of the first portion 152 and the second portion 154 of the torso segment 150, it should be understood that a single rocker member 176 or multiple rocker members 176 may be coupled to each of the first portion 152 and the second portion 154 of the torso segment 150.

Ones of the rocker members 176 coupled to the first portion 152 of the torso segment 150 and ones of the rocker members 176 coupled to the second portion 154 are aligned with one another in the longitudinal direction and generally extend in a direction that is transverse to the longitudinal direction. The rocker members 176 are movably coupled to the primary support frame 120. In particular, the rocker members 176 are movably coupled to at least one guide 178 that is coupled to the longitudinal frame 126 of the primary support frame 120.

In embodiments, the rocker members 176 and/or the at least one guide 178 have a curved or arced shape such that the rocker members 176 rotate about an axis 10 with respect to the primary support frame 120, where the axis 10 extends in the longitudinal direction. The rocker members 176 and/or the at least one guide 178 include a radius of curvature that generally corresponds to a radius 12 extending from the axis 10 to the rocker members 176.

The rocker members 176 may include a toothed member 175 that is engaged with the at least one guide 178. The toothed member 175 may be positioned on an outer circumference of the rocker members 176. Alternatively or additionally, the toothed member 175 may be positioned on a side face of the rocker members 176. An actuator 180 is coupled to at least one of the guides 178 and moves the rocker members 176 with respect to the primary support frame 120. The actuator 180 may include one or more gears or screws (not depicted) that are engaged with the toothed member 175 of the rocker members 176, such that the actuator 180 and the rocker members 176 are engaged with one another in a fashion similar to a rack and pinion configuration. As the actuator 180 drives the one or more gears or screws meshed with the toothed member 175, the actuator 180 moves rocker members 176 with respect to the at least one guide 178. In embodiments, the actuator 180 may include various actuators, including, but not limited to an electric motor, a hydraulic actuator, a pneumatic actuator, or the like.

Referring to FIG. 4, the actuator 180 is communicatively coupled to the electronic controller 200. The electronic controller 200 sends signals to the actuator 180 which command the actuator 180 to move the rocker members 176 with respect to the primary support frame 120. In embodiments, the actuator 180 may include various actuators including, but not limited to an electrical motor or the like. A healthcare professional may utilize the user input 210 to send a signal to the electronic controller 200 to command the actuator 180 to move the rocker members 176 with respect to the primary support frame 120.

Referring again to FIG. 1A, the actuator 180 moves the rocker members 176 with respect to the at least one guide 178, the actuator 180 rotates the rocker members 176 about the axis 10 with respect to the primary support frame 120. As the first portion 152 and the second portion 154 of the torso segment 150 are coupled to the rocker members 176, when the rocker members 176 rotate about the axis 10 with respect to the primary support frame 120, the first portion 152 and the second portion 154 of the torso segment 150 rotate about the axis 10 with respect to the primary support frame 120.

While the actuator 180 is depicted as being positioned proximate to the torso segment 150 and as being directly engaged with the rocker members 176, it should be understood that the actuator 180 may be positioned at any suitable position on the person support apparatus 100 and may be engaged with the rocker members 176 through a variety of mechanical linkages.

The rocker members 176, the guides 178, the actuator 180, and the first portion 152 and the second portion 154 of the torso segment 150 are formed from materials such that the person support apparatus 100 may be suitable for use with a variety of medical equipment, such as an X-ray machine. In embodiments, each of the rocker members 176, the guides 178, the actuator 180, and the first portion 152 and the second portion 154 of the torso segment 150 may be formed from a variety of materials, including, but not limited to, polymers, composites, resins, carbon fiber or the like.

The person support apparatus 100, and in particular the repositioning assembly 170 of the person support apparatus 100, repositions a patient by rotating the first portion 152 and the second portion 154 of the torso segment 150 about axis 10 with respect to the primary support frame 120. For example, a patient may initially be positioned in a prone position, as depicted in FIG. 1A. During a surgical procedure, such as a spinal procedure, it may be necessary to reposition the patient from the prone position to a lateral position in which the patient is laying on his or her side, as depicted in FIG. 3A. To facilitate repositioning of the patient, the person support apparatus 100, and in particular the repositioning assembly 170, is repositionable between a first position and a second position and intermediate positions therebetween.

Referring to FIG. 1A, the person support apparatus 100 is initially positioned in a first position, in which the patient may be initially in the prone position. In the first position, the first portion 152 of the torso segment 150 is substantially co-planar with the horizontal plane (i.e., the X-Y plane as depicted) and may be co-planar with the longitudinal frame 126 of primary support frame 120. The first portion 152 of the torso segment 150 may also be substantially co-planar with the upper segment 140 and/or the leg segment 160 when the person support apparatus 100 is in the first position. The second portion 154 of the torso segment 150 is severally coupled to and is oriented transverse to the first portion 152 of the torso segment 150. Accordingly, the second portion 154 of the torso segment 150 is also oriented transverse to the longitudinal frame 126 in the first position.

Figure 2:
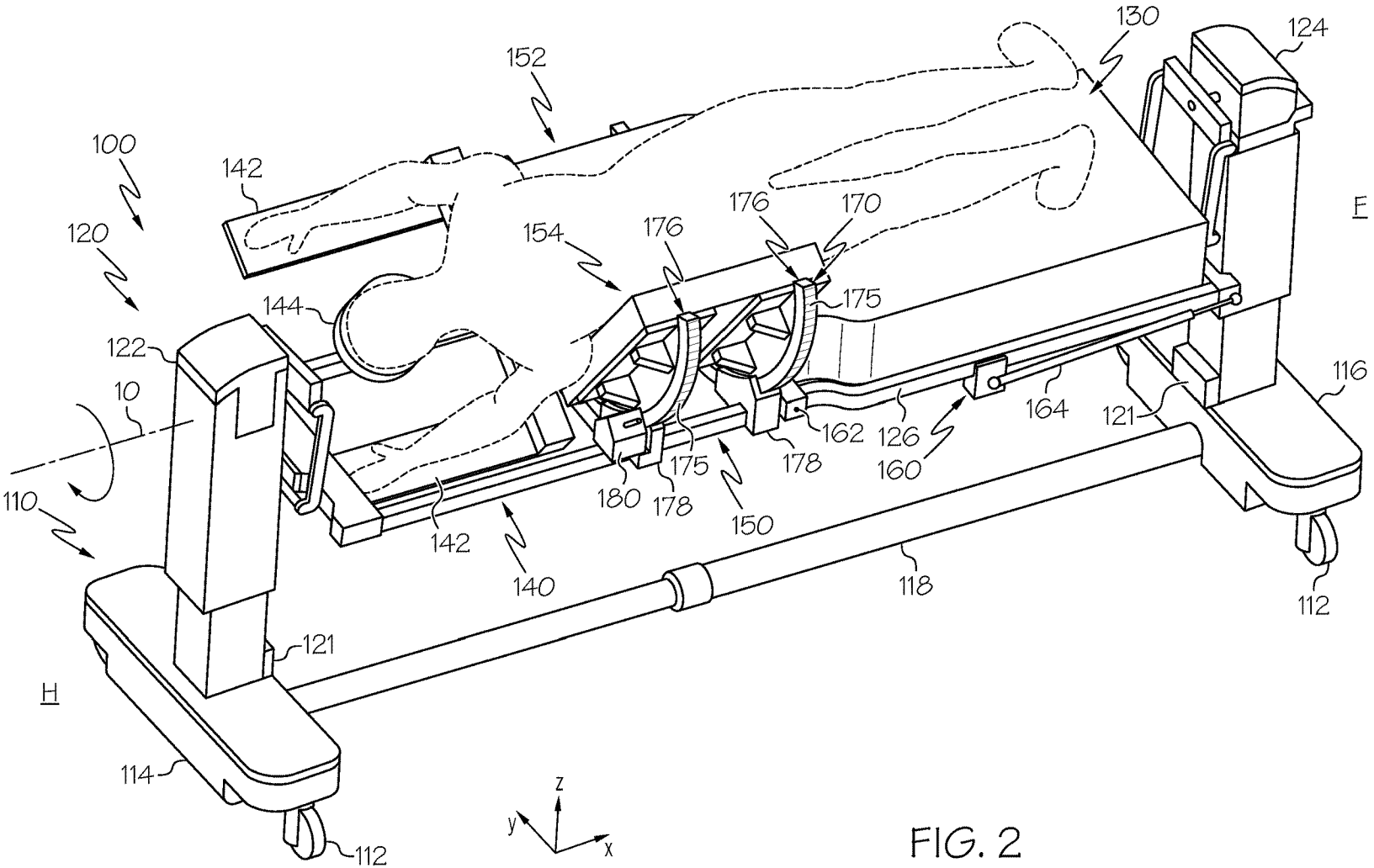
FIG. 2 schematically depicts a perspective view of the person support apparatus of FIG. 1A repositioning a patient from a prone position to a lateral position according to one or more embodiments shown or described herein.

Referring to FIG. 2, to reposition the person support apparatus 100 between the first position and the second position, the actuator 180 moves one of the rocker members 176 and the first portion 152 and/or the second portion 154 of the torso segment 150 that are coupled to the rocker members 176. In particular, the actuator 180 rotates the rocker members 176 and the first portion 152 and the second portion 154 about the axis 10. In the embodiment depicted in FIG. 2, the upper segment 140 is coupled to the first portion 152 of the torso segment 150 such that the upper segment 140 rotates about the axis 10 with the first portion 152 of the torso segment 150. In other embodiments, the torso segment 150 is not coupled to either the upper segment 140 or the leg segment 160 such that the torso segment 150 rotates about the axis 10 while the upper segment 140 and the leg segment 160 remain stationary.

The rocker member 176 that is coupled to the first portion 152 continues to rotate and the actuator 180 engages the rocker member 176 that is coupled to the second portion 154 of the torso segment 150. Once engaged with the rocker member 176 that is coupled to the second portion 154 of the torso segment 150, the actuator 180 continues to rotate the torso segment 150 to reposition the person support apparatus 100 into the second position.

Referring to FIG. 3A, the person support apparatus 100 is depicted in the second position. In the second position, the second portion 156 of the torso segment 150 is substantially co-planar with the horizontal plane (i.e., the X-Y plane as depicted), thereby positioning the patient in a lateral position. In particular, the patient's side is positioned on the second portion 156 of the torso segment 150, which is substantially co-planar with the longitudinal frame 126 such that the patient is laying on his or her side. As described above, the second portion 154 of the torso segment 150 is oriented transverse to the first portion 152 of the torso segment 150. Accordingly, when the person support apparatus 100 is in the second position, the first portion 152 is oriented transverse to the longitudinal frame 126. Once the person support apparatus 100 is in the second position, the first portion 152 of the torso segment 150 may be removed from the second portion 154.

While the person support apparatus 100 is described and depicted as showing the repositioning assembly 170 moving a patient between a prone position and a lateral position, it should be understood that the person support apparatus 100 may be utilized to move a patient between additional rotational positions. For example, the person support apparatus 100 may be utilized to reposition a patient between the lateral position, as shown in FIG. 3A and a supine position (not depicted), or between the supine position and a lateral position. Further, while the actuator 180 is depicted as rotating the torso segment 150 in the clockwise direction about the axis 10, it should be understood that the actuator 180 may rotate the torso segment 150 in the counterclockwise direction about the axis 10.

It should now be understood that the person support apparatuses according to the present disclosure include repositioning assemblies that move a patient between various positions. In embodiments, the repositioning assemblies include at least one rocker member that is coupled to a torso segment of the person support apparatus and that is movably coupled to a primary support frame of the person support apparatus. The at least one rocker member rotates the torso segment with respect to the primary support frame and is repositionable between a first position and a second position. By rotating the torso segment with respect to the primary support frame, the repositioning assembly may rotate a patent on the person support apparatus between rotational positions, such as between a prone position and a lateral position. By rotating the patient between the different rotational positions with the repositioning assembly of the person support apparatus, a patient may be repositioned as required during a surgical procedure with minimal manual handling of the patient by medical staff, thereby reducing risk to the patient and the medical staff.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A person support apparatus comprising:

a base frame;

a primary support frame supported on the base frame, wherein the primary support frame extends in a longitudinal direction;

a support deck coupled to the primary support frame, the support deck comprising:

an upper segment positioned at a head end of the person support apparatus;

a leg segment positioned at a foot end of the person support apparatus; and a torso segment positioned between the upper segment and the leg segment in the longitudinal direction, wherein:

the torso segment comprises a first portion and a second portion oriented transverse to the first portion; and the second portion is selectively coupled to and removable from the first portion;

a first rocker member coupled to the first portion of the torso segment; and a second rocker member coupled to the second portion of the torso segment, wherein:

the first rocker member and the second rocker member are aligned with one another in the longitudinal direction; and the first portion and the second portion of the torso segment rotate with respect to the primary support frame about a common axis that extends in the longitudinal direction.

2. The person support apparatus of claim 1, wherein the leg segment is pivotally coupled to the primary support frame.

3. The person support apparatus of claim 1, wherein at least one of the first rocker member and the second rocker member has a radius of curvature with respect to the axis.

4. The person support apparatus of claim 1, wherein the upper segment is coupled to the torso segment.

5. A person support apparatus comprising:

a base frame;

a primary support frame supported on the base frame, the primary support frame comprising a longitudinal frame that extends in a longitudinal direction and is positioned above the base frame in a vertical direction;

a support deck coupled to the longitudinal frame of the primary support frame, the support deck comprising a torso segment; and a repositioning assembly coupled to at least a portion of the support deck, the repositioning assembly comprising:

at least one rocker member coupled to the torso segment and movably coupled to the primary support frame, the at least one rocker member extending in a direction that is transverse to the longitudinal direction and defining an outer circumference comprising a radius of curvature that corresponds to a radius extending between the outer circumference and an axis extending in the longitudinal direction, the at least one rocker member comprising a toothed member extending along the outer circumference; and an actuator coupled to the primary support frame and engaged with the at least one rocker member, wherein the actuator moves the at least one rocker member with respect to the primary support frame about the axis extending in the longitudinal direction.

6. The person support apparatus of claim 5, wherein the support deck further comprises an upper segment positioned at a head end of the person support apparatus.

7. The person support apparatus of claim 6, wherein the upper segment is coupled to the torso segment.

8. The person support apparatus of claim 5, wherein the actuator engages the toothed member of the at least one rocker member in a rack and pinion fashion.

9. A person support apparatus comprising:

a base frame;

a primary support frame supported on the base frame, the primary support frame comprising a longitudinal frame that extends in a longitudinal direction and is positioned above the base frame in a vertical direction, wherein at least a portion of the longitudinal frame extends in a horizontal plane;

a support deck coupled to the longitudinal frame of the primary support frame, the support deck comprising a torso segment comprising a first portion and a second portion selectively coupled to and removable from the first portion; and a repositioning assembly coupled to at least a portion of the support deck and movably coupled to the primary support frame, the repositioning assembly comprising:

a first rocker member coupled to the first portion of the torso segment;

a second rocker member coupled to the second portion of the torso segment, wherein the first rocker member and the second rocker member are aligned with one another in the longitudinal direction; and wherein the repositioning assembly moves the first portion and the second portion of the torso segment about a common axis that extends in the longitudinal direction, moving the torso segment between a first position in which the first portion is co-planar with the horizontal plane and a second position in which the second portion is co-planar with the horizontal plane.

10. The person support apparatus of claim 9, wherein the support deck further comprises a leg segment coupled to the primary support frame.

11. The person support apparatus of claim 9, wherein the first portion of the torso segment is oriented transverse to the second portion of the torso segment.

12. The person support apparatus of claim 9, wherein the support deck further comprises an upper segment coupled to the torso segment.

13. The person support apparatus of claim 9, wherein at least one of the first rocker member and the second rocker member comprises a toothed member.

14. The person support apparatus of claim 13, wherein the repositioning assembly further comprises an actuator coupled to the primary support frame, wherein the actuator is engaged with at least one of the first rocker member and the second rocker member.

15. The person support apparatus of claim 14, wherein the actuator engages the toothed member of the at least one of the first rocker member and the second rocker member in a rack and pinion fashion.

16. The person support apparatus of claim 9, wherein at least one of the first rocker member and the second rocker member rotates about the common axis and the at least one of the first rocker member and the second rocker member comprises a radius of curvature with respect to the common axis.

* * * * *